United States Patent [19]

Godtschalck

[11] 4,129,347

[45] Dec. 12, 1978

[54] STRUCTURE FOR SUPPORTING AND GUIDING A DRAWER

[75] Inventor: Lucien J. Godtschalck, Orsay, France

[73] Assignee: Krieg & Zivy Industries, Le Plessis-Robinson, France

[21] Appl. No.: 758,182

[22] Filed: Jan. 10, 1977

[30] Foreign Application Priority Data

Jan. 16, 1976 [FR] France ..... 76 01061

[51] Int. Cl.[2] ..... A47B 88/00

[52] U.S. Cl. ..... 312/330 R; 312/334; 321/341 R; 312/111; 308/3.6

[58] Field of Search ..... 312/351, 341 NR, 330, 312/332, 350, 261, 108, 111, 334, 341; 5/200 R, 202; 308/3.6, 3.8

[56] References Cited

U.S. PATENT DOCUMENTS

| | | | |
|---|---|---|---|
| 183,276 | 10/1876 | Alexander | 308/3.6 |
| 699,724 | 5/1902 | Thompson | 308/3.6 |
| 1,319,431 | 10/1919 | Straubel | 312/351 |
| 1,585,999 | 5/1926 | Lundeen | 308/3.6 |
| 2,312,325 | 3/1943 | Earle | 312/330 |
| 2,364,766 | 12/1944 | Zalkind | 312/261 |
| 2,539,963 | 1/1951 | Moberg | 312/350 |
| 2,609,024 | 9/1952 | Russ | 312/330 |
| 2,614,016 | 10/1952 | Regenhardt | 312/111 |
| 2,657,968 | 11/1953 | Soehner | 312/332 |
| 2,726,915 | 12/1955 | Schuette | 312/341 |
| 2,937,765 | 5/1960 | Shank | 312/341 NR |
| 3,264,049 | 8/1966 | Peterson | 312/350 |
| 3,312,516 | 4/1967 | Krahn | 312/330 |
| 3,552,579 | 1/1971 | Simon | 312/108 |
| 3,606,506 | 9/1971 | Ungard | 312/111 |

*Primary Examiner*—Victor N. Sakran
*Attorney, Agent, or Firm*—Charles E. Brown

[57] ABSTRACT

A structural element for supporting and guiding a sliding drawer and a frame structure including at least two such structural elements. The structural element is of rectangular traylike construction, essentially comprising a flat support member of preferably open structure which supports the drawer on spaced two-part runners matingly fitted in preformed openings in lateral strips of the support member and a flange which runs along the lateral sides of the support member and preferably the rear transverse side, too. A releasable or overridable abutment dog is provided on the forward transverse strip for preventing the drawer from slipping out of frame. In association with at least two parallel spaced structural elements, the structural frame preferably comprises complementary elements including interconnecting spacer members between adjacent superposed structural elements as well as a top surface member and a base member secured at the top and bottom, respectively, for providing a standing frame for a set of drawers.

11 Claims, 8 Drawing Figures

STRUCTURE FOR SUPPORTING AND GUIDING A DRAWER

The present invention relates generally to a structural element for supporting and guiding a drawer and a frame structure including the structural element for receiving and guiding one or more drawers.

Up to now, such a frame structure usually comprises a piece of wooden furniture of predetermined shape and capacity, which may be made to order or of conventional design, using wooden panels suitably cut, shaped and assembled.

In any case the overall configuration of the frame structure is rigidly fixed during assembly so that it is not easy to alter the capacity as a function of requirements at some later time.

Moreover, in case of a set of drawers provided inside a built-in or standing clothes closet or cupboard, or a storage unit of this kind, the skills of a trained workman are required for the assembly thereof; only rarely, upon disassembly, is the frame structure reusable in a closet or cupboard other than the one for which it was designed.

A general object of the present invention comprises the provision of a frame structure, adapted to receive and guide any kind of drawer, which is free of the foregoing drawbacks, the frame structure being, in addition, marketable in kit form for assembly by most anybody.

A more specific main object of the invention is the provision of a supporting and guiding element adapted to receive and guide a drawer, characterized in that it is of generally flat or traylike configuration, comprising a support member of rectangular outer shape provided with a shallow flange along at least its two lateral sides.

Preferably, and according to a preferred embodiment, the flange also extends along the rear transverse side of the support member, and in order to reduce its weight, the support member comprises an open structure, including two lateral strips connected by at least two transverse or cross strips.

In any event, by the association of the support member and the flange provided thereon, the present support and guiding element itself is capable of supporting and laterally guiding a drawer, the support member ensuring the support of the drawer and the flange the guiding action.

Furthermore, owing to the shallow height of the flange on the support and guiding element which is nonetheless sufficient to afford suitable lateral guiding of a drawer, as mentioned above, the drawer supporting and guiding member constitutes a compact structural element which therefore facilitates packaging, storage and marketing.

Although the present drawer supporting and guiding element may be used alone, for example fixed to a structural wall, the supporting and guiding element which, on its own, is a generally flat, two-dimensional unit is, owing to its flange, capable of constructing, as desired, three-dimensional frame structures adapted to receive one or a set of drawers, depending on the particular requirements.

To this end the flange of the supporting and guiding element has preformed spaced recesses for fastening means, such a screws, on the outside of the lateral flanges. Thus it is possible to fix complementary structural elements laterally, for instance, spacer members adapted to connect the supporting and guiding element either to a top plate member parallel to the supporting and guiding elements when constructing a frame structure adapted to guide a single drawer, or to another, similar drawer supporting and guiding element parallel to the first supporting and guiding element and so on by alternately mounting guiding and supporting elements and spacer members up to a top surface member thereby providing a frame structure for supporting and guiding a set of two or more drawers.

Similarly it is possible, owing to the flange, to secure to the lowermost supporting and guiding element a base member which may have legs.

The assembly of such a frame structure consists merely of screwing parts together and to a support, which has the advantage of being within the skills of most anybody, so that a trained workman is not needed.

Further, upon partial or total disassembly of the elements which is just as easy assembly, it is possible to alter the frame structure as desired, for example, to adapt to new capacity requirements and/or a new location, the overall configuration of the structure or frame previously assembled.

Furthermore, the present drawer supporting and guiding element and likewise the complementary spacer elements, top member or base member which may be associated therewith and which may advantageously be sold with it in kit form, either alone or with a supporting and guiding element, is preferably of moulded plastics material to form a single frame structure. Parts of different materials, such as runners reducing the drawer friction bearing surface for better sliding of the drawer, may be fitted on the frame structure. However, the strict predetermined dimensions of the frame structure advantageously eliminate any problem of assembly and use which is frequently encountered with conventional sets of drawers made from wooden panels.

Another aspect of the present invention is the provision a frame structure for one or a set of drawers comprising at least one supporting and guiding element.

The objects, features and advantages of the present invention will be brought out in the following description, given by way for example, with reference to the accompanying schematic drawings, in which:

FIG. 1 illustrates the use of supporting and guiding elements for constructing a frame structure for receiving and guiding three drawers 10, although it goes without saying, and it will be brought below, that there may be any number of drawers.

Figure 2:
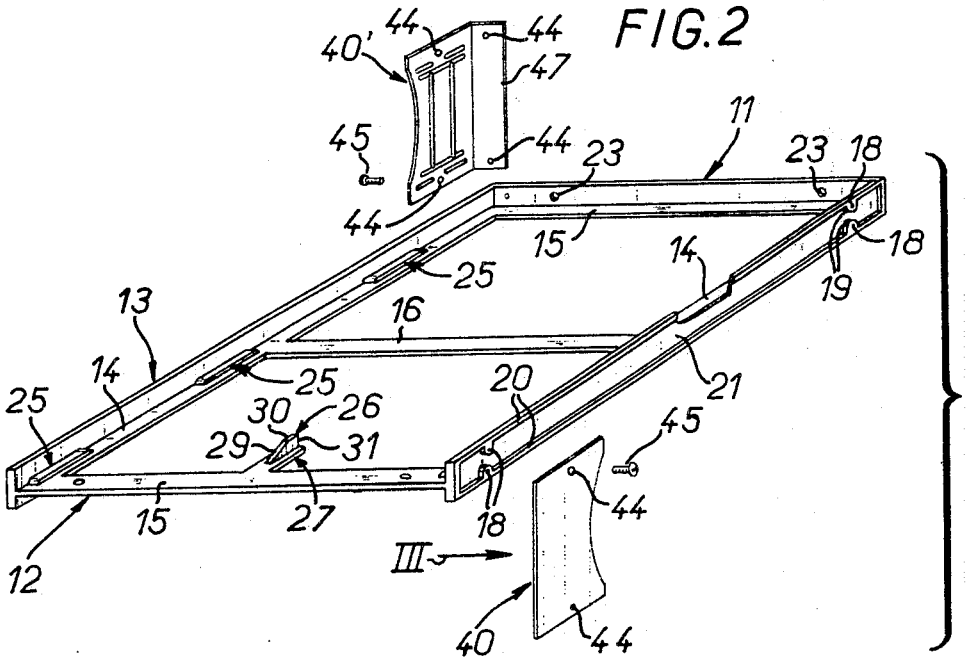
FIG. 2 is a perspective view of a drawer supporting and guiding element of the frame structure, with cutaway details of two different types of spacer members adapted to interconnect such supporting and guiding elements.

In any event, a supporting and guiding element 11, shown alone in FIG. 2, is provided for each drawer. Each drawer supporting and guiding element 11 forms a structural element and is of generally traylike configuration, comprising a support member 12 of rectangular outer shape, and a shallow flange 13 along at least its two lateral sides. In practice, and as illustrated, the support member 12 comprises an open frame formed by two lateral strips 14 connected to each other by at least two transverse strips 15 which are preferably, as illustrated, disposed at the ends of the lateral strips 14. Preferably, and as illustrated, an additional transverse strip 16 is provided intermediate the end transverse strips 15.

Likewise, in practice and as illustrated, the flange 13 of the supporting and guiding element 11 extends along not only the opposed lateral sides of the support plate 12 but also the rear transverse side, on the corresponding transverse strip 15.

In the illustrated embodiment the flange protrudes in both directions, from upper and lower sides of the support member 12, perpendicular to the support member.

In any case, preformed spaced recesses 18, adapted to receive fastening means such as screws, are provided for laterally fixing other elements thereto, as will be explained hereinafter.

In practice the recesses 18 are blind holes in raised lugs 19. The lug 19 are located inside a ribbed periphery defined by ribs 20 along the edges of the outside surface 21 of the flange 13. The lugs 19 and ribs 20 are thus both raised with respect to the outside surface 21 of the flange 13.

Preferably and as illustrated, the preformed recesses 18 are arranged in two offset rows and aligned in pairs in planes perpendicular to the general plane of the support plate 12, the raised lugs 19 project from the respective ribs 20 generally towards each other so that, as will be understood later, it is possible to fix to the outside face of the flange 13 other complementary elements above or below the supporting and guiding element 11.

The flange 11 of the supporting and guiding element 11 preferable comprises at least one passage or opening 23 adapted to receive any kind of fastening means, such as screws, for fixing it to any other support, e.g., a wall. In the illustrated example two passages or openings 23 are provided, each being in the rear transverse portion of the flange 13 running along the transverse strip 15 of the support member 12.

Besides its structure, and more particularly besides the ribs which define the periphery thereof, the flange 13 of the supporting and guiding element 11 has the advantage of excellent rigidity characteristics.

Figure 6:
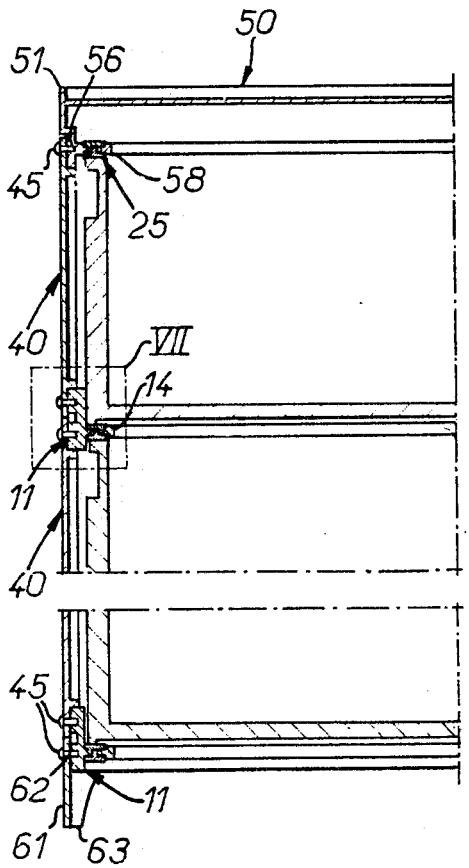
FIG. 6 is a partial cross-sectional view of the frame structure for a set of drawers represented in FIG. 1, taken on the line VI—VI.
Figure 7:
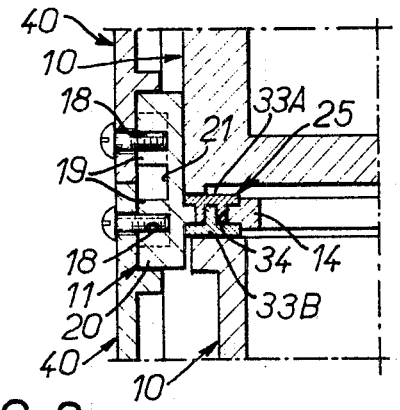
FIG. 7 is a detail, on an enlarged scale, of the portion enclosed in dash-dotted line VII.
Figure 8:
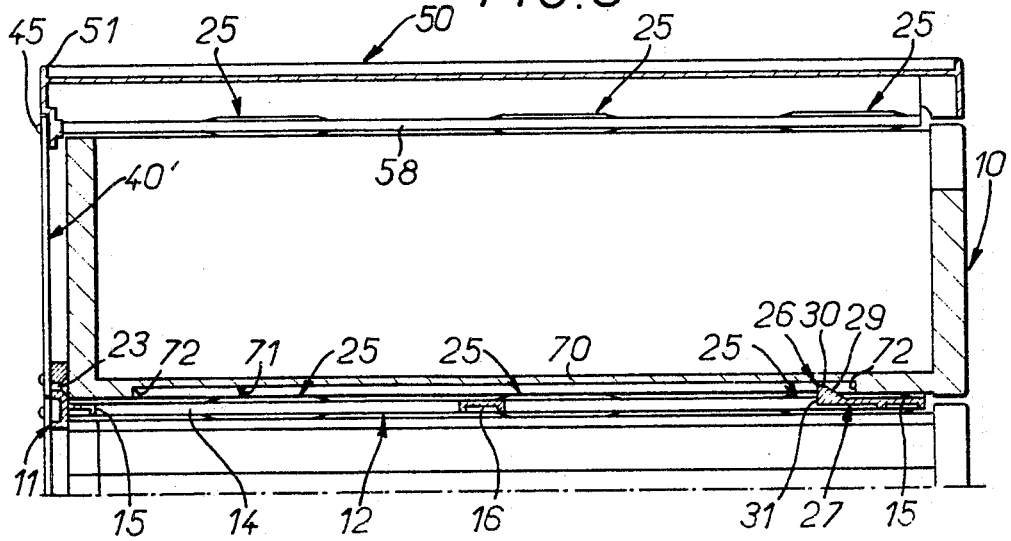
FIG. 8 is partial cross-sectional view of the frame structure for a set of drawers in FIG. 1, taken along the line VIII—VIII in FIG. 1.

Preferably, and as illustrated, the support member 12 of the supporting and guiding element 11, and more particularly the lateral strips 12 defining the lateral sides thereof, carry raised runners 25 at spaced locations, the operative surfaces of the runners 25 being coplanar. As can be better seen in FIGS. 6–8, the runners 25 project from both the upper surface or side of the support member 12 and the lower side thereof.

In addition to the runners 25, which shall be described in greater detail hereinbelow, the support member 12 also supports an abutment dog 26. It is preferable for the abutment dog to be releasable or overridable when a force is exerted against it parallel to the lateral sides of the support member 12 in one direction of action only.

In practice, the abutment dog 26 is, accordingly, carried on a tongue 27 which overhangs and extends rearwardly from the forward transverse strip 15 of the support member and is elastically deformable.

In practice also, the abutment dog 26 is a platelike portion substantially perpendicular to the tongue 27, the upper edge of the platelike portion having, in succession, an inclined insertion edge 29, a central portion 30 parallel to the tongue 27 and a transverse shoulder 31 perpendicular to the tongue.

Figure 5:
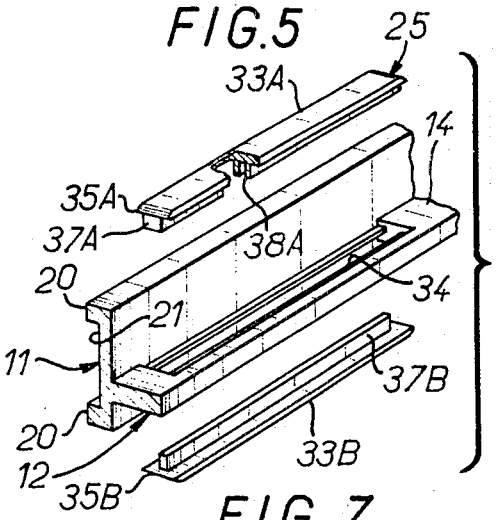
FIG. 5 is an exploded fragmentary perspective view, on a different scale, of the supporting and guiding element with its runners.

As will be easily understood the supporting and guiding element 11 preferably comprises a one-piece moulded element of plastics material, e.g., shock resistent polystyrene. On the other hand, the runners 25 are preferably of material different from the rest of the element 11, such as low pressure polyethylene. Accordingly, and as may be seen in FIG. 5, each runner 25 is of two-part construction 33A–33B adapted to be secured to the support member 12 from each side thereof.

Preferably, and as illustrated, for each runner 25 the corresponding lateral strip 14 has an elongate opening 34; part 33A of the corresponding runner 25 defines a female part having projecting from a retaining plate 35A, a rib 37 with a groove 38A; the other part 33B forming a male part and having a tongue 37B complementary to and matable with the groove 38A of the female part 33A. As it will be readily understood, the constituent parts 33A and 33B of each runner 25 may be fitted in each other, inside the elongate opening 34 in the support member 12, like the parts of a two-piece rivet(see FIGS. 5 and 7).

As mentioned above, such a supporting and guiding element may be associated with various complementary structural elements, such as spacer members 40,40', which are adapted to form supporting spacer members for interconnecting parallel, spaced-apart support and guiding element to one another.

Figure 3:
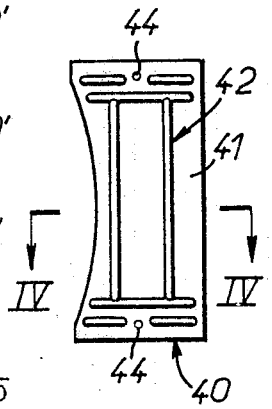
FIG. 3 shows a detail, in elevational view and on an enlarged scale, of a spacer member viewed in the direction of arrow III in FIG. 2.
Figure 4:
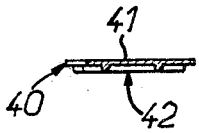
FIG. 4 is a cross-sectional view of a spacer member, taken along line IV—IV in FIG. 3.

It will be better understood by reference to FIGS. 2–4, a spacer member 40 is simply formed as a flat plate 41, with stiffening ribbing 42 projecting from one of its sides, adapted to be secured at each of its ends to one side of flange 13 of a supporting and guiding element 11. The spacer members 40 are preferably provided with preformed apertures or passages at its ends for cooperation with fastening means, such as screws 45, adapted to come into engagement with the preformed recesses 18 on the flange of the supporting and guiding element and with the preformed recesses 18 on an associated sub- or superjacent supporting and guiding element.

The spacer member 40' is in all ways similar to the above described spacer member 40, but since it is to be disposed at the rear of a supporting and guiding elements 11 its flat plate 41' is bounded at one end along its height by a right-angled portion 47. Like the flat plate 41, the right-angle portion 47 has passages or apertures 44 for receiving fastening means or screws 45.

Figure 1:
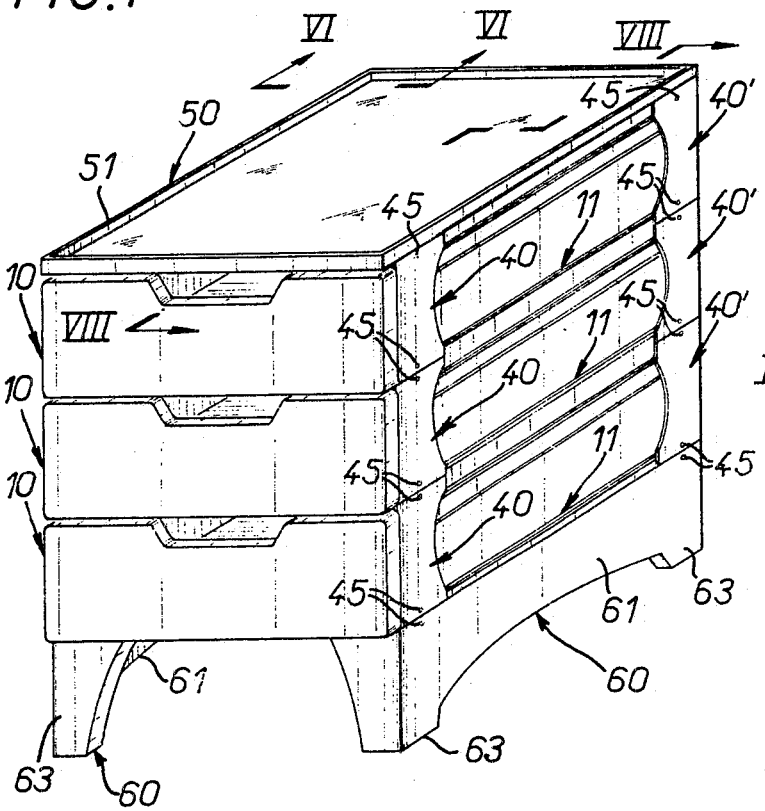
FIG. 1 is an isometric view of a frame structure for a set of drawers having drawer supporting and guiding elements, together with corresponding drawers.

For the assembly of the frame structure for the set of three drawers illustrated in FIG. 1, the supporting and guiding elements 11 are three in number and interconnected in pairs by the spacer members 40,40'. The spacer members associated with the supporting and guiding element 11 and the upper drawer 10 are, in addition, connected to a complementary element adapted to form a top surface member 50 of the frame for the set of drawers.

The top surface member 50 has a flange 51 around its entire periphery, projecting at least from its lower side, and as in the illustrated embodiment, to both sides. The top flange 51 has preformed recesses 52 (see FIG. 6), like those of the flanges of the supporting and guiding elements, which recesses 52 are adapted to receive fastening means, such as screws 45, for fixing it laterally to the corresponding spacer members 40,40' connecting it to the flange 13 of the subjacent supporting and guiding element 11.

In the illustrated embodiment the top flange 51 bounding the top surface 56 carries on its inner surface, below and parallel to the corresponding plate surface, lateral strips 58 provided with runners 25 (FIGS. 6 and 8), like the lateral strips of the support member 12 described above.

In association, and even though such a frame structure may be supported directly on a floor or other supporting surface on its lower-most supporting and guiding element 11, there is provided at least one complementary element forming a base member 60.

In the illustrated embodiment the two-part base member 60 is associated with the lowermost supporting and guiding element 11, one on each lateral side of the supporting and guiding element. Each of the parts of the base 60 comprises a side wall 61 which by means of preformed recesses 62 and screws 45 (FIG. 6) is adapted to be secured to the particular lateral side of the supporting and guiding element 11, each end of the base member 60 being provided with a foot 63.

The drawers 10 per se are not part of the present invention and therefore will not be described in detail herein.

It is sufficient to point out that they are of any known type but, preferably, as shown in the illustrated embodiment, wherein they each comprise a groove 71 extending along the undersurface of its bottom 70 with transverse shoulders 72 at its ends, which groove 71 cooperates with the abutment dog 26 on the elastic tongue on the corresponding support member 11.

When a drawer 10 is slid into an opening defined by a pair of adjacent superposed supporting and guiding elements 11, the lower edge of the drawer 10 comes into contact with the inclined edge 29 of the abutment dog 26 which is accordingly elastically depressed until the abutment dog 71 clears the edge and can take on its normal position again.

From then on, the abutment dog 26 is engaged in groove 71 of the drawer 10. When the drawer is opened the abutment dog abuts against the transverse shoulder 72 at the end of the groove 71, which defines the positive limit of the outward sliding movement of the drawer in its groove, thereby preventing the drawer 10 from slipping out of the frame structure.

It will be noted that during opening of the drawer, the latter is supported only on the runners 25 of the corresponding support member 12, i.e., the immediately lower supporting and guiding element, and more precisely on the upper operative surface of the runners, although the downwardly projecting runners 25 of the superjacent supporting and guiding element for the two lower drawers, or of the lateral strips 58 of the top element 50 of the upper drawer also take part in the guiding of the drawers for sliding movement; the lateral sides of the drawers are therefore also in contact with the runners 25 along their upper and lower edges.

It goes without saying that the contact between the lateral sides of the drawers with the superajacent is not essential, this drawer being borne essentially on the subjacent runners. The superjacent runners prevent, however, the raising of the drawer during opening and closing.

In conjunction therewith, the lateral guiding of the drawer in sliding movement is effected by the flange of the subjacent supporting and guiding element, the underside of this element thus being adapted to receive and guide the drawer on its flange. Although this is the case in illustrated embodiment, such a drawer needs no groove for guiding its sliding movement.

Wherever appropriate, the passages in the supporting and guiding element 11 may be used to secure the structural unit to a wall.

Of course the present invention is not limited to the illustrated and described embodiment but encompasses all variations within the scope of the claims.

In particular, the portions of the flange 13 of a supporting and guiding element along the rear transverse strip thereof could, under certain circumstances, be eliminated. Also, the support member could be a nonperforate plate. Similarly the runners 25 which are not essential, although highly desirable, could be moulded in the support member 12. Moreover, the releasable elastic abutment dog 26 could be of a different nature than described, for example formed of parts secured to the support member 12.

Finally, a supporting and guiding element may be used alone, mounted, for instance, on a base, or fixed to a support by way of the aperture or passage 23, for example.

In any event it ought to be stressed that the present supporting and guiding element divides its functions between the support member which, even when of open structure, supports an associated drawer and the flange which alone effects the lateral guiding function.

What is claimed is:

1. A frame structure comprising a plurality of unitary structural elements arranged in spaced superimposed relation for supporting and guiding sliding drawers therebetween, each said structural elements including a rectangular support member having lateral sides, a plurality of runner inserts disposed in said rectangular support member along said lateral sides thereof and extending through said lateral sides to project both above and below said lateral sides, said runner inserts having upper surfaces arranged coplanar for supporting and facilitating sliding of a respective overlying drawer and lower surfaces arranged coplanar for guiding an upper part of an underlying drawer, and a shallow upstanding flange integral with and extending along each of said lateral sides of said support member for guiding a drawer for sliding movement, the flanges of each of said structural elements having spaced preformed recesses for receiving means for fixedly securing said structural elements to other supports to retain said structural elements in said superimposed spaced relation.

2. A frame structure according to claim 1, wherein each said flange protrudes substantially perpendicularly from both the upper and lower surfaces of said support member.

3. A frame structure according to claim 1, wherein said recesses are arranged in two distinct rows and aligned in pairs in planes perpendicular to the plane of said support member, said recesses being adapted to secure both upwardly and downwardly extending other supports.

4. A frame structure according to claim 1, wherein each said support member is provided with an abutment dog retractable in response to a force exerted in a single direction parallel to said lateral sides.

5. A frame structure according to claim 4, wherein each said support member includes a forward transverse strip, and the abutment dog is disposed on a tongue extending rearwardly from the forward transverse strip of said support member.

6. A frame structure according to claim 1, wherein each said structural element is of a one-piece moulded plastics construction.

7. A frame structure according to claim 1, wherein said runner inserts secured to said support member are made of a material other than that of the support member; said material having a low coefficient of friction as compared to the material of said support member.

8. A frame structure according to claim 7, wherein each of said runner inserts is mounted in an opening in said support member and includes a male part and a female part in mating relation extending from opposed sides of the corresponding opening thereinto.

9. A frame structure according to claim 1, further comprising at least one complementary element associated with one of said structural elements for forming a base member.

10. A frame structure according to claim 9, wherein each said complementary element comprises a side wall adapted to be secured to one of the lateral sides of said one structural element, and each complementary element having a foot at each end.

11. A frame structure according to claim 1, further comprising a complementary element forming a top surface member having a flange extending around its periphery and at least downwardly therefrom, spaced preformed recess means for lateral securement by fasteners, and spacer members adapted to interconnect the top surface member to an uppermost one of said structural elements.

* * * * *